United States Patent [19]

Welhoelter

[11] Patent Number: 4,725,200

[45] Date of Patent: Feb. 16, 1988

[54] APPARATUS AND METHOD FOR REDUCING RELATIVE MOTION BETWEEN BLADE AND ROTOR IN STEAM TURBINE

[75] Inventor: Stephen A. Welhoelter, Casselberry, Fla.

[73] Assignee: Westinghouse Electric Corp., Pittsburgh, Pa.

[21] Appl. No.: 18,320

[22] Filed: Feb. 24, 1987

[51] Int. Cl.[4] ..... F01D 5/10

[52] U.S. Cl. ..... 416/221; 416/500

[58] Field of Search ..... 416/500, 220 R, 221, 416/193 A

[56] References Cited

U.S. PATENT DOCUMENTS

| | | | |
|---|---|---|---|
| 1,619,133 | 3/1927 | Kasley | 416/220 R |
| 2,684,831 | 7/1954 | Grantham | 416/221 X |
| 2,753,149 | 7/1956 | Kurti | 416/220 R X |
| 2,843,356 | 7/1958 | Hull | 416/220 R X |
| 2,930,581 | 3/1960 | Klint | 416/219 R |
| 3,759,633 | 9/1973 | Tournere | 416/220 R |
| 4,022,545 | 5/1977 | Shank | 416/221 |
| 4,037,990 | 7/1977 | Harris | 416/220 R |

FOREIGN PATENT DOCUMENTS

| | | | |
|---|---|---|---|
| 976790 | 3/1951 | France | 416/220 R |
| 986022 | 7/1951 | France | 416/220 R |
| 418618 | 8/1974 | U.S.S.R. | 416/193 A |

*Primary Examiner*—Everette A. Powell, Jr.

[57] ABSTRACT

An apparatus and method for use in steam turbines of the type employing axial entry blades comprises a plurality of resilient rings disposed in a generally axially extending slot in the base of each blade root. The rings urge each root radially outward so as to minimize blade flop during turning gear operation.

18 Claims, 5 Drawing Figures

APPARATUS AND METHOD FOR REDUCING RELATIVE MOTION BETWEEN BLADE AND ROTOR IN STEAM TURBINE

BACKGROUND OF THE INVENTION

1. Field of the Invention

The present invention relates generally to steam turbines and more specifically to steam turbines of the type employing "axial entry" blades. The present invention has particular application to steam turbines employing axial entry, free-standing blades, but is not limited thereto.

2. Description of the Prior Art

Steam turbines of the type employing axial entry blades generally comprise a rotor having a plurality of generally axially extending grooves disposed thereround and a plurality of blades. Each blade has a root in registration with one of the grooves. Typically, the roots and grooves each have a generally fir tree shape. Blades employing this design may be of either the free-standing type or of the integral shroud type. Either way, a problem with this design is that the blades may "flop" during turning gear operation of the rotor, i.e., the centrifugal force is generally insufficient during turning gear operation to urge the blade roots radially outward against edges of the grooves, and therefore the root can rock circumferentially in its groove. "Flop" may cause root/groove fretting and undesired noise. In the case of integral shroud blades, "flop" may also cause wear of opposing shroud faces. Obviously, these are undesirable conditions.

Certain steam turbines manufactured by Brown Boveri Corporation are known to to implement one means as an attempt to solve this problem. That means comprises a plurality of radially oriented holes disposed in the bottom of each blade root. A coil spring is disposed in each hole and contacts the bottom of the groove with which the root registers. Apparently, it is the function of the springs to urge the roots radially outward against the edges of the groove with which they register. The problem with this solution is that it is mechanically complicated, and the radially oriented holes may weaken the blade root. Further, the amount of force that may be exerted by the coil spring is limited by the size of the hole that can be drilled in the root and by the size of the coil spring that may be placed therein.

The assignee of the present application has utilized two other methods in an attempt to solve the blade "flop" problem. The first involves cementing each blade root in its respective groove with an adhesive such as Loctite®. The second involves placing shims, such as kicker shims, between the bottom-most portion of each root and the bottom of the groove with which it registers. The shims urge the blade roots radially outward against the edges of the grooves. The problem with these methods is that turbine disassembly may be complicated and time-consuming.

It is therefore an object of the present invention to provide an apparatus and method for eliminating blade "flop" that is simple to implement, reliable, efficient and that renders turbine disassembly a simple matter.

SUMMARY OF THE INVENTION

Apparatus for reducing blade "flop" in a steam turbine comprises resilient ring means disposed in a slot machined in the base of each root. The ring means each have an outer periphery that urges against the top of the slot and the bottom of the groove so as to exert a generally radially outward force against the root. A shim having a pair of free ends may be disposed on the bottom of each groove whereupon the free ends are bent radially outward to cover open ends of the slot. Recessed areas may be provided on inlet and outlet side faces of the roots for seating the free ends of the shims.

According to the preferred practice of the invention, the ring means comprise a plurality of resilient rings disposed in each slot. The rings each have an outer diameter such that the periphery thereof urges against the top of the slot and the shim, thereby exerting the root generally radially outward. The magnitude of the force applied by the rings is determined, at least in part, by the inner diameter of the rings.

A method of constructing a steam turbine incorporating the rings of the present invention comprises machining a slot of fixed depth along the bottom of each root and inserting a shim on the bottom of each groove. The blade roots are inserted in their respective grooves over the shim, and the rings are inserted in the slots. Free ends of the shims are bent radially outward to cover open ends of the slot.

Reference is made to commonly assigned co-pending application Ser. No. 7/18,321, filed 2-24-87 for a related but alternate solution to the problem addressed by this invention.

DESCRIPTION OF THE PREFERRFD EMBODIMENT

Figure 1:
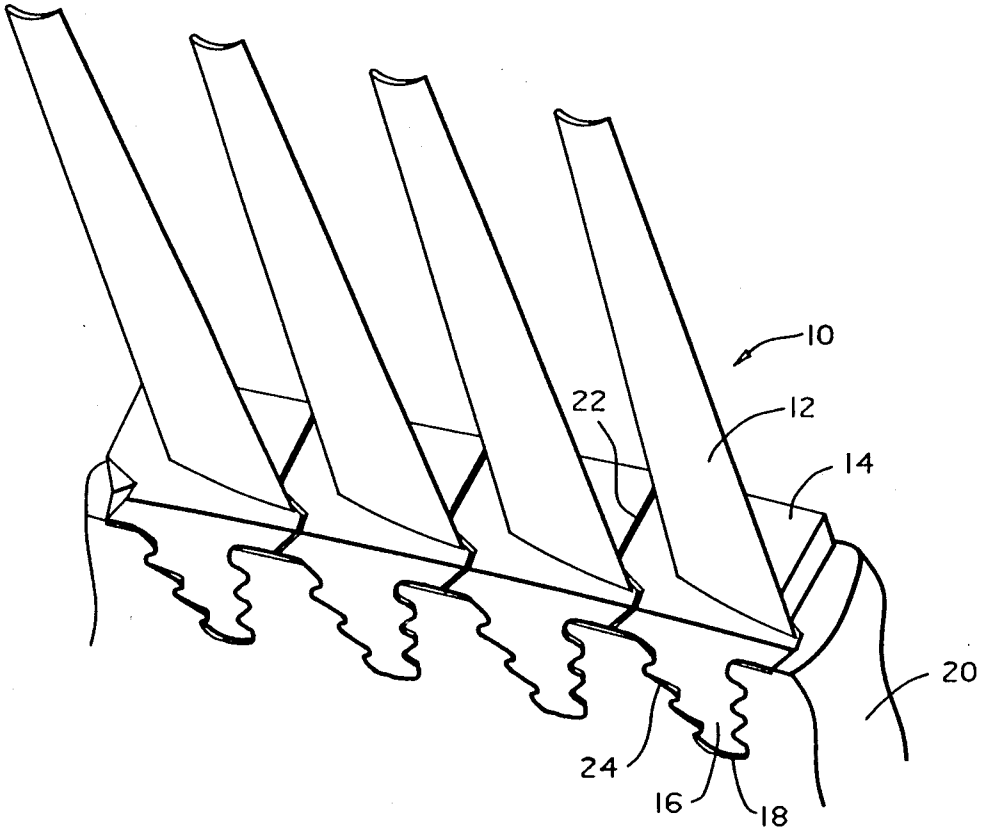
FIG. 1 is a perspective view of a portion of a turbine of the type employing free-standing blades.

Referring now to the drawings, wherein like numerals represent like elements, there is illustrated in FIG. 1 a portion of a rotor labelled generally 10 and comprising a rotor 20 having a plurality of generally axially extending, generally fir tree-shaped grooves 18. Circularly disposed around the rotor 20 are a plurality of free-standing blades 12 each having a platform 14 and a generally fir tree-shaped root 16 in registration with one of the grooves 18. Although free-standing blades are illustrated, it should be understood that the present invention is not limited to steam turbines of this type, i.e., the invention may also be used in steam turbines employing integral shroud type blades.

As also illustrated in FIG. 1, there may be a small clearance 22 between adjacent platforms 14 which may open further under hot rotor conditions. Additionally, there may be a small clearance 24 between each blade root 16 and the edges of the groove 18 with which it registers. The existence of the small clearances 22, 24 may result in blade "flop".

Figure 2:
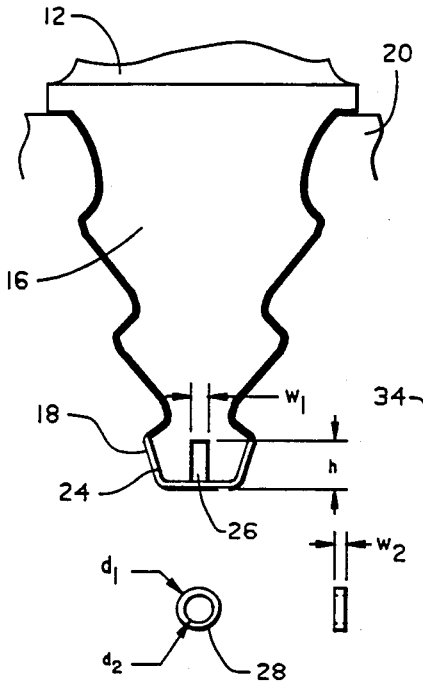
FIG. 2 is a view of a blade root according to the present invention taken along the axial direction of the rotor.
Figure 3:
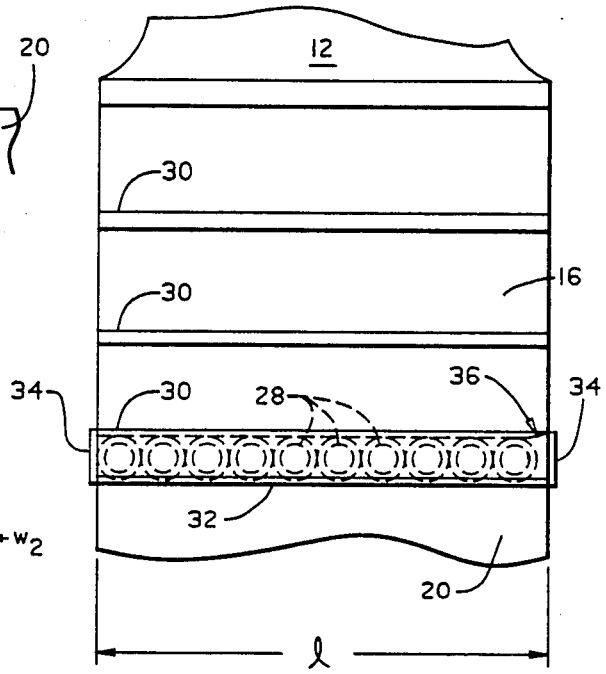
FIG. 3 is a side view of a blade root according to the present invention taken along the tangential direction of the rotor.

Referring now to FIGS. 2 and 3, an apparatus and method for reducing blade flop will be described.

Disposed in the base of each root 16 is a generally axially extending slot 26. The slot 26 extends the full axial length 1 of the root 16 and has a depth h. The slot 26 may be machined in the base of the root utilizing any one of a number of well known machining methods.

A plurality of resilient rings 28 are provided. Each ring 28 has an outside diameter $d_1$ and an inside diameter $d_2$. Preferably, the rings 28 have an outside diameter $d_1$ such that the periphery of each ring 28 urges against the top of the slot 26 and a shim 32 described hereinafter.

As also illustrated in FIG. 2, each ring 28 has a width $w_2$ approximate the width $w_1$ of the slot 26. In most cases, a specific root style may be provided with rings 28 having a standard outer diameter $d_1$ and a standard width $w_2$. The inner diameter $d_2$ may be varied to provide the necessary seating force for a specific blade, as discussed below.

As best illustrated in FIG. 3, a shim 32 is disposed on the bottom of each groove 18. A plurality of rings 28 are disposed in the slot 26 and, as mentioned, are sized so that their periphery urges against the base of the root 16 and the shim 32. The rings thus apply a generally radially outward force against the root 16. The force exerted by the rings 28 urges bearing lands 30 of the root 16 against edges of the groove 18 so as to prevent relative motion therebetween. The number of rings inserted in each slot depends primarily on the length 1 of the blade root—the rings may be sized so that there is a specific number of rings per root length. As mentioned, the inner diameter $d_2$ may be varied to provide the desired seating force for a specific blade. Calculations have shown that a ring 28 with an outer diameter $d_1$ of 0.250 inches, an inner diameter d of 0.165 inches and a width $w_2$ of 0.095 inches can easily seat a 100 pound free-standing blade.

Preferably, the rings are resilient and constructed of stainless steel, and more particularly, of ASTM 422 stainless steel due to its corrosion resistance and high strength. Other materials may be used depending upon the load.

Referring again to FIG. 3, it is seen that each shim 32 has a pair of free ends 34 bent radially outward along each side of the root to cover open ends of the slot 26. The bent up free ends 34 keep the rings 28 in the slot 26 during turbine operation, i.e., under high speed when the blade may be further forced radially outward by centrifugal force. The shim 32 also serves to take up any clearance between the outside diameter $d_1$ of the rings 28 and the bottom of the groove 18.

Figure 4:
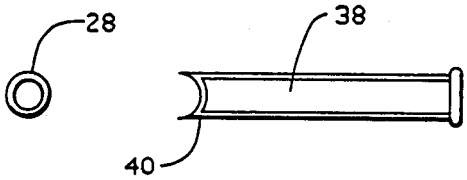
FIG. 4 illustrates a tool for use in connection with the practice of the present invention.

As illustrated in FIG. 4, a tool 38 having a blunt end 40 with a curvature approximate the curvature of the rings 28 may be utilized to drive the rings 28 into the slots 26.

A method of assembling a turbine to incorporate the above-disclosed apparatus will now be described.

A method of constructing a steam turbine according to the present invention comprises the steps of machining a slot 26 of fixed depth h along the base of each root and providing plurality of elongated shims 32, each shim 32 having a length 1 plus twice the depth h of the slot 26. Shim 32 is positioned on the bottom of each groove 18 so that the free ends 34 thereof overlay the ends of the groove 18. A blade root is then inserted in its respective groove over the shim and a predetermined number of rings are inserted through one end of the slot 26. If desired, one end of the slot may be chamfered such as shown at 36 for ease of installation of the rings 28. The free ends of each shim 32 are then bent radially outward to cover the open ends of each slot 26. If desired, the tool 38 may be utilized to drive each ring 28 into its slot 26.

Figure 5:
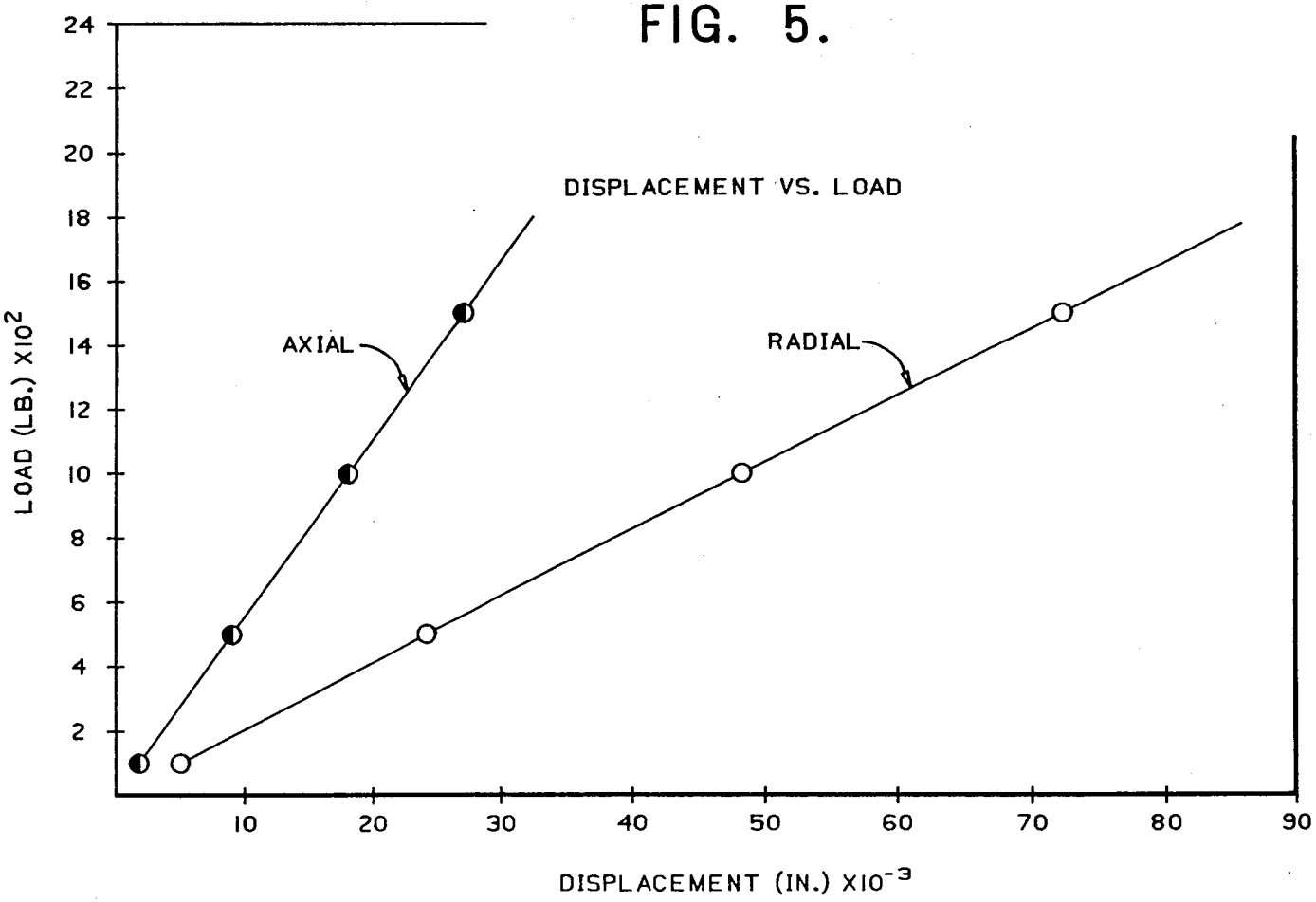
FIG. 5 is a graph of blade performance.

FIG. 5 is a graph of blade displacement (both radial and axial) versus loading and demonstrates satisfactory performance (i.e., minimal flop) over a wide range of loading conditions.

The present invention may be embodied in other specific forms without departing from the spirit or essential attributes thereof and, accordingly, reference should be made to the appended claims, rather than to the foregoing specification, as indicated the scope of the invention.

I claim as my invention:

1. In a steam turbine having a rotor with a plurality of grooves disposed therearound and a plurality of blades, each blade having a root in registration with one of the grooves, each root having a base, an apparatus for reducing relative motion between each root and its corresponding groove comprising resilient ring means disposed in a slot machined in the base of each root, the ring means having an outer periphery that urges against the top of the slot and the bottom of the groove, the ring means thereby exerting a generally radially outward force against each root.

2. Turbine according to claim 1 further comprising a shim disposed between the base of each root and the bottom of each groove, each shim having a pair of free ends bent radially outward along sides of the root to cover open ends of the slot.

3. Turbine according to claim 1 wherein the blades are free standing blades.

4. Turbine according to claim 1 wherein the ring means are constructed of stainless steel.

5. Turbine according to claim 1 wherein the rotor grooves extend generally in the axial direction of the motor and the rotor grooves and blade roots have a generally fir tree shape, the slot in the base of each root extending in the general direction of the groove with which the root registers.

6. In a steam turbine having a rotor with a plurality of grooves disposed therearound and a plurality of blades, each blade having a root in registration with one of the grooves, each root having a base, the improvement comprising:

(a) a slot machined in the base of each root in the general direction of the groove with which the root registers; and (b) a plurality of rings disposed in each slot, each ring having a periphery that urges against the top of the slot and the bottom of the rotor groove, the rings thereby exerting a generally radially outward force against each blade root.

7. Turbine according to claim 6 wherein the rotor grooves generally extend in the axial direction of the rotor, and the rotor grooves and blade roots each have a generally fir tree shape.

8. Turbine according to claim 6 wherein the rings are resilient.

9. Turbine according to claim 8 wherein the rings are constructed of stainless steel.

10. Turbine according to claim 6 wherein the blades are free standing blades.

11. Turbine according to claim 6 wherein each ring has an inner diameter, the amount of force exerted by each ring being determined, at least in part, by the inner diameter of the ring.

12. Turbine according to claim 6 further comprising a shim disposed between the base of each root and the bottom of each groove, each shim having a pair of free ends bent radially outward along sides of the root to cover open ends of the slot.

13. Steam turbine comprising:

(a) a rotor having a plurality of generally fir tree shaped, generally axially extending grooves disposed therearound;

(b) a plurality of free standing blades circularly disposed around the rotor, each blade having a generally fir tree shaped root in registration with one of the rotor grooves, each root having a base, there being a slot in the base in the general direction of the groove;

(c) a shim disposed between the base of each root and the bottom of each groove, each shim having a pair of free ends bent radially outward along sides of each root to cover open ends of each slot; and (d) a plurality of resilient stainless steel rings disposed in each slot, each ring having an outer periphery that urges against the top of the slot and the shim, the rings thereby exerting a generally radially outward force against each root, the magnitude of the force being determined, at least in part, by the inner diameter of the rings.

14. In a steam turbine of the type having a rotor with a plurality of generally fir tree shaped, generally axially extending grooves and a plurality of blades, each blade having a generally fir tree shaped root in registration with one of the grooves, a method of assembling the turbine to reduce relative motion between each root and its corresponding groove at low rotational speeds comprising the steps of:

(a) machining a slot in the bottom of each root in the general direction of the groove; and (b) inserting a plurality of resilient rings in each slot, each ring having an outer periphery that urges against the top of the slot and the bottom of the groove thereby exerting a radially outward force against each root.

15. Method according to claim 14 further comprising the steps of:

(a) inserting a shim between the bottom of each root and the bottom of each groove, each shim having a free end overlaying the ends of each groove; and (b) bending the free ends of each shim radially outward to cover open ends of each slot.

16. Method according to claim 14 wherein the step of inserting a plurality of resilient rings in each slot comprises the steps of:

(a) providing a tool having a blunt end with a curvature approximate the curvature of the rings; and (b) positioning the blunt end of the tool over each ring and driving each ring into its respective slot with the tool.

17. Method of constructing a steam turbine comprising the steps of:

(a) providing a rotor with a plurality of generally fir tree shaped, generally axially extending grooves therearound;

(b) providing a plurality of blades, each blade having a generally fir tree shaped root;

(c) machining a slot of fixed depth along the bottom of each root;

(d) providing a plurality of elongated shims, each shim having a length approximate the length of the rotor groove plus twice the slot depth;

(e) inserting a shim on the bottom of each groove and positioning the shim so that free ends thereof overlay ends of the groove;

(f) inserting a root in each groove over the shim;

(g) providing a plurality of resilient rings, each ring having an outside diameter such that, when inserted into a slot, there will be an interference fit provided by the periphery of each ring between the top of each slot and each shim;

(h) inserting a predetermined number of rings through an end of and into each slot; and (i) bending the free ends of each shim radially outward to cover the open ends of each slot.

18. Method according to claim 17 wherein the step of inserting a predetermined number of rings through an end of and into each slot comprises the further step of:

(a) providing a tool having a blunt end with a curvature approximate the curvature of the rings; and (b) positioning the blunt end of the tool over each ring and driving each ring into its respective slot with the tool.

* * * * *